United States Patent [19]

Peyton

[11] 4,124,969

[45] Nov. 14, 1978

[54] BOX OPENING APPARATUS

[75] Inventor: John J. Peyton, Santa Barbara, Calif.

[73] Assignee: Industrial Automation Corporation, Santa Barbara, Calif.

[21] Appl. No.: 820,594

[22] Filed: Aug. 1, 1977

[51] Int. Cl.[2] ..... B65B 43/39

[52] U.S. Cl. ..... 53/382; 214/304

[58] Field of Search ..... 53/382, 381 R; 214/304

[56] References Cited

U.S. PATENT DOCUMENTS

| | | | |
|---|---|---|---|
| 2,761,263 | 9/1956 | Bruce | 53/382 |
| 2,890,560 | 6/1959 | Nigrelli et al. | 53/382 |
| 2,918,773 | 12/1959 | Krupp et al. | 53/382 |

*Primary Examiner*—Travis S. McGehee

*Attorney, Agent, or Firm*—Blakely, Sokoloff, Taylor & Zafman

[57] ABSTRACT

A box opening apparatus for automatically opening the closed (unsealed) flaps of cartons delivered on a conveyor. The initial lifting of the longitudinal flaps is by a stream of air or by vacuum. Thereafter the undersides of the slightly lifted flaps engage a blade which urges the flaps upward, with helical rails completing the opening of the longitudinal flaps. A drag link engages the rear lateral flap, pivoting the flap open as the carton moves along the conveyor. A hook member is coupled to an endless chain moving substantially faster than the conveyor and synchronized with the movement of cartons on the conveyor. The hook member is disposed and synchronized to engage the underside of the front lateral flap when in the closed position, and to move in an upwardly and then downwardly sloping direction followed by a horizontal trajectory segment to rotate the flap to the open position. Provisions for retaining the flaps in an open condition, as well as other features and improvements for such equipment, are disclosed.

29 Claims, 10 Drawing Figures

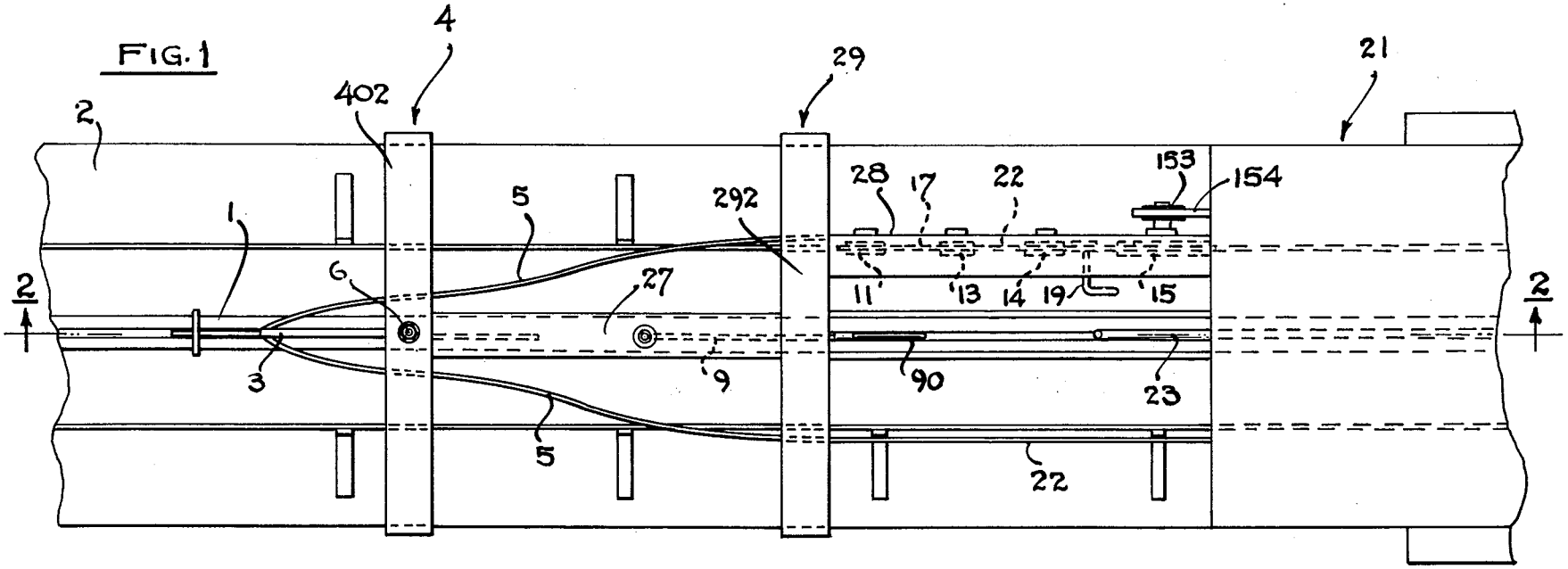
FIG. 1
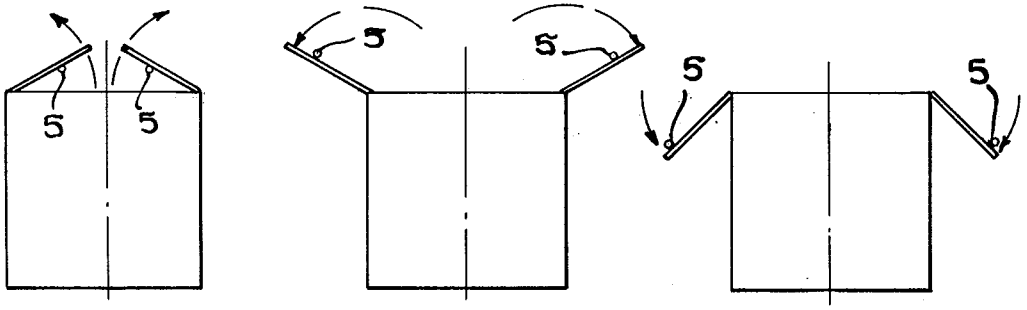
FIG. 4C
FIG. 4B
FIG. 4A

BOX OPENING APPARATUS

BACKGROUND OF THE INVENTION

1. Field of the Invention

The present invention is related to the field of carton handling apparatus, and more particularly to apparatus for automatically opening the flaps of an unsealed, closed carton.

2. Description of the Prior Art

The bottling and packaging industry has long utilized machinery for automatically opening the flaps of cartons and propelling the opened cartons along a delivery conveyor for other operations, such as automatically removing empty containers from the cartons, packing a finished product in the carton, and automatically closing the flaps of the carton. The present invention is concerned with an apparatus which automatically prepares a closed carton by opening the flaps of the carton and disposing them outward so that the interior of the carton is easily accessible for removing or placing material in the carton.

Various types of mechanisms have been devised to open each of the flaps of a box as it moves through, or is stationary on, a delivery conveyor. Perhaps the most difficult flap to open, in terms of the complexity of apparatus required, is the front lateral flap of the box, (e.g. "front" relative to the motion of the carton on the delivery conveyor). The front flap must be opened by a force in the direction of the carton movement; thus a passive element such as a simple plow or hook mechanism which remains stationary cannot be used.

One type of device utilized to open the front flap, U.S. Pat. No. 2,918,773, issued to Krupp et al, is an apparatus comprising a pair of endless chains reeved around sprockets for movement parallel to the delivery conveyor. A rod is attached to corresponding links in each chain and extends outwardly over the carton to engage the flap of the box when the flap has been momentarily lifted by an air jet discharging into the carton. The chain is driven at a lateral speed faster than the movement of the carton on the delivery conveyor, so that the flap is urged forward by the movement of the rod and chain mechanism, thereby opening the flap. However this type of apparatus suffers from the limitation that a means for initially lifting the front flap of the carton must be provided so that the rod attached to the chain will have an initial position on the flap to urge the flap forward, since that rod can be disposed no lower than the top of the carton sides. The apparatus disclosed in U.S. Pat. No. 2,918,773 accomplishes the initial lifting of the flap by directing a stream of air under the flap and into the carton interior, thereby urging the flap upward by the air pressure.

Another method for initially lifting the front flap so that a moving rod or roller can engage the underside of the flap is disclosed by U.S. Pat. No. 3,019,924, issued to Krupp et al. A telescoping spear impales the flap, and further movement of the case through the conveyor system lifts the flap slightly but does not completely open the flap. Still another example of a method for opening a front flap of a box is disclosed by U.S. Pat. No. 3,224,165, issued to Nigrelli et al. Nigrelli utilizes suction cups, selectively activated by application of a vacuum to the cups, which engage the front flap and initially lift the flap so that the typical endless chain mounted rod may engage the underside of the front flap to complete the opening process. Each of the above described apparatus suffers from the limitation that not only must an endless chain mechanism be provided for opening the flap, but also another apparatus for initially lifting the front flap above the level of the carton sides must be provided, which adds to the complexity and expense of the apparatus. Further, not only must additional apparatus be provided, but the action of the initial flap opening mechanism must be synchronized both with the carton movement and the means for completing the flap opening. Another disadvantage of both Krupp et al patents is that an endless chain is mounted on both sides of the box for suspending the rod and disposing it under the front flap, further complicating the apparatus.

BRIEF SUMMARY OF THE INVENTION

An apparatus for opening the flaps of an unsealed closed carton moving on a delivery conveyor is disclosed. For opening the forward flap in the embodiment disclosed, an endless chain engages first and second sprockets journaled in an elevated frame member for disposing the chain in a vertical plane parallel to the delivery conveyor. First and second spaced idler sprockets engage the chain between the first and second sprockets, the first idler sprocket disposed between the first sprocket and second idler, the second idler disposed between the first idler and second sprocket, and the chain passing over the first idler and under the second idler. A bar extends from a link of the chain above the path of travel of a carton on the delivery conveyor. A hook member is integrally coupled to the bar, and as the chain is driven at a lineal speed substantially in excess of that of the delivery conveyor, the tip of the hook member dips below the sides of the carton to engage the underside of the front flap of the carton when the chain link through which the pin extends passes the underside of the first sprocket. The hook travels in a inclined trajectory above the carton, thereby lifting the flap upward to an approximately vertical disposition at the idler sprocket. Once the pin travels over the first idler sprocket, the pin and hook movement is downwardly inclined, since the chain passes underneath the second idler and second sprocket, and thereby urges the front flap downward to an open position. Thereafter the flap passes under a retainer bar extending parallel to the delivery conveyor for retaining the front flap in an open position.

Means for opening each of the other flaps of the carton prior to opening the forward flap as well as other features and improvements for such equipment are also disclosed. The longitudinal flaps are substantially opened by helical rails as the carton moves along the conveyor after having been initially lifted by a jet of air or vacuum. The rear lateral flap is opened by engagement by a drag link which catches the flap and causes it to pivot open upon passage of the carton.

BRIEF DESCRIPTION OF THE DRAWINGS

FIG. 1 is a top view of one embodiment of the present invention for opening the flaps of a carton.

FIGS. 4*a* through 4*c* are end views of the apparatus sequentially showing the opening of the longitudinal flaps of a carton by the helical rails.

DETAILED DESCRIPTION OF THE INVENTION

Figure 2:
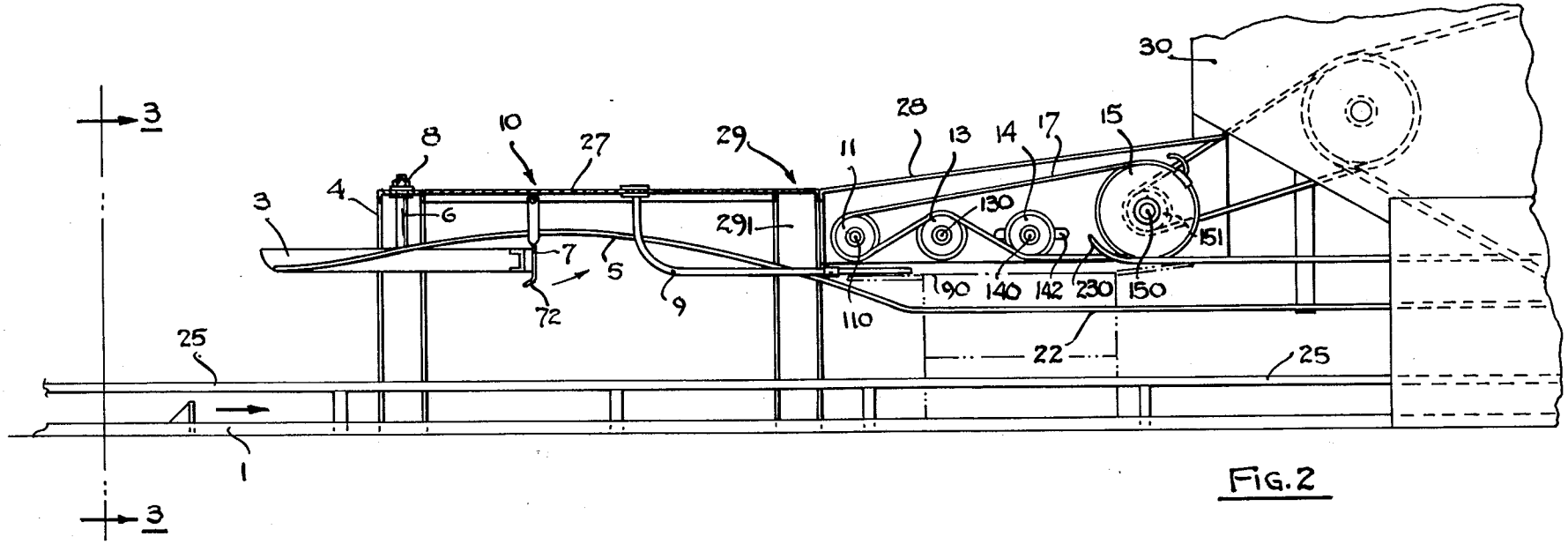
FIG. 2 is a side view of the flap opening apparatus.

First referring to FIGS. 1 and 2, a top view and a side view, respectively, of the present invention may be seen. A conventional delivery conveyor 1 is shown extending longitudinally for transporting the cartons. The carton for which the present invention is designed is the typical cardboard carton, having a rectangular shape in plan view, each side of the carton foldably connected to a top flap for enclosing a portion of the top of the carton. Therefore there are four top flaps, the two longitudinal flaps having the greatest length, and the two lateral flaps, hereinafter individually designated as a rear lateral flap and a front lateral flap. The closed cartons are disposed on a delivery conveyor which moves in the direction shown in FIG. 2, with the front lateral flap of the carton being that flap located at the leading side of the carton determined by the direction of movement of the box on the conveyor.

The carton moves along the conveyor and through the flap opening apparatus, where the top flaps of the carton are opened so that the carton interior is accessible for whatever operations are to be performed, as for example, removal of bottles. In the following discussion, reference will be made to "upstream" and "downstream" directions, "downstream" refering to the direction of movement of the conveyor, and "upstream" refering to the direction opposite the direction of movement of the conveyor.

In the preferred embodiment of the present invention, the apparatus for opening the top flaps of a carton comprises (i) vacuum means and blade for initially lifting the longitudinal flaps; (ii) helical rails for engaging the undersides of the longitudinal flaps and constraining the flaps to fold over and downward toward the sides of the carton as the carton moves along the conveyor; (iii) a drag link pivotably attached to a first frame member for lifting the rear lateral flap; (iv) the front flap opening apparatus; and (v) retainers for maintaining the flaps in the opened position.

Figure 3:
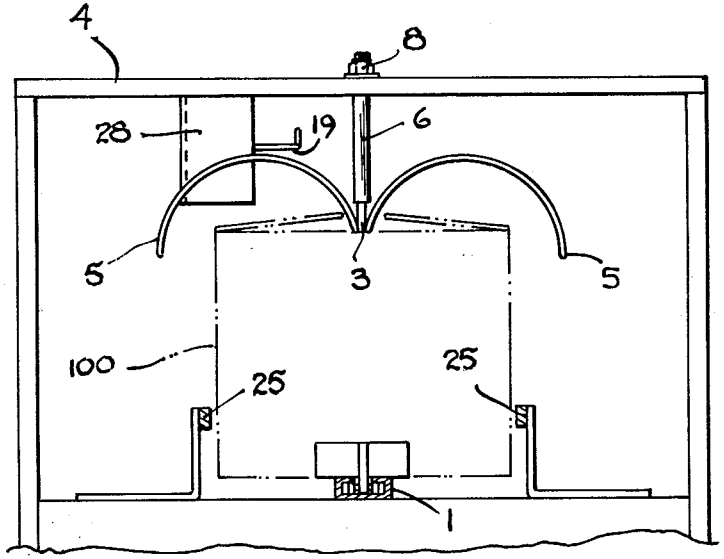
FIG. 3 is an end view of the present invention as viewed from the carton input end of the conveyor.
Figure 5A:
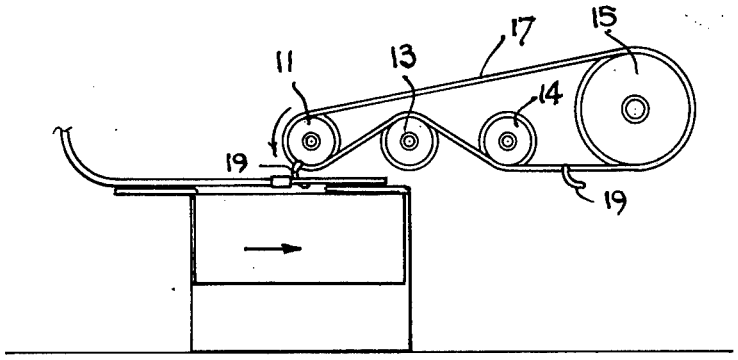
FIGS. 5*a* through 5*d* are side views of the front flap opening apparatus, sequentially showing the front flap opening mechanism opening the front flap of a carton.
Figure 5B:
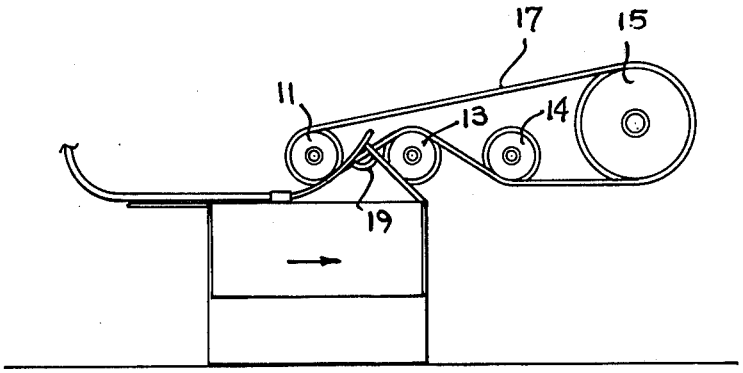
Figure 5C:
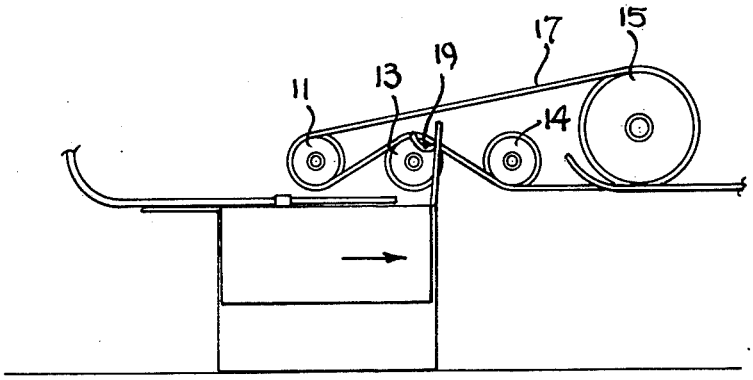
Figure 5D:
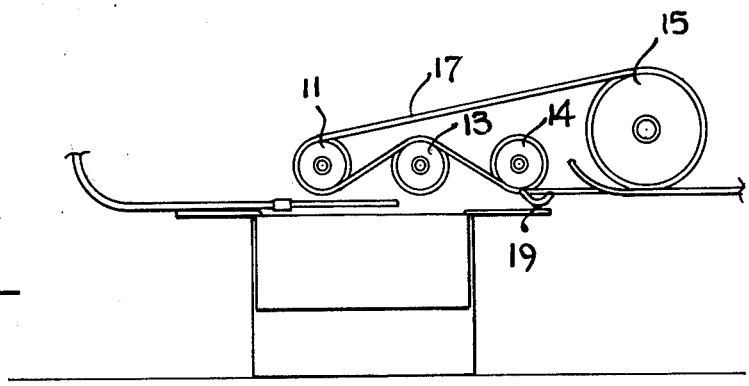

Referring now to FIG. 2, blade 3 is suspended from first frame structure 4 by bolt 6 at a height just above the height of the sides of the carton to be opened, and parallel to the delivery conveyor 1. The blade 3 is a pointed member disposed parallel to the path of a carton along the delivery conveyor just above the junction of the folded longitudinal flaps. Two helical rails 5 are attached to the sides of blade 3 and extend downstream along the delivery conveyor. Rails 5 curve gently upward and outwardly, and then downwardly in a helical manner as shown in FIGS. 2 and 3. The closed longitudinal flaps are partially lifted by a stream of air or vacuum means (not shown). Blade 3 and rails 5 engage the undersides of the partially lifted longitudinal flaps, and guide the flaps open as carton movement progresses on the conveyor, best shown in FIGS. 4(*a–c*). The downstream ends of helical rails 5 are connected to longitudinal flap retainers 22, each disposed along a side of the delivery conveyor, for contacting and retaining the longitudinal flaps in a substantially open position, once opened by the helical rails 5. These longitudinal flap retainers 22 comprise substantially straight rods extending horizontally along the sides of the delivery conveyor, as shown in FIG. 2. It is not necessary that the longitudinal flaps be completely folded down adjacent the carton sides, only that the flaps be folded downward to clear other parts of the apparatus and other downstream processing machinery. Therefore the position of longitudinal flap retainers 22 may be adjusted to fold the flaps over to the degree desired.

Referring to FIG. 2, second frame structure 29 is secured vertically and downstream from first frame structure 4, and comprises two side members 291 extending vertically, one on each side of the conveyor, and a top member 292 attached horizontally to the tops of the side members. U-shaped strut 27 is attached to top members 402 and 292 of first and second frame members 4 and 29, and extends horizontally and parallel to the movement of the conveyor 1. A drag link 7 is pivotably suspended on strut 27 just downstream from plow 3 by a horizontal transverse pin 10. Thus link 7 may pivot about pin 10 in a vertical plane parallel to the direction of conveyor movement. The lower end of link 7 is tapered and curved upstream to form a dogleg 72. As shall subsequently be seen, the drag link rides over the forward flap to fall under and hook the rear flap to force it to the open position on movement of a carton thereby. Rear flap retainer 9 is attached to strut 27 downstream of link 7, as shown in FIG. 2, and comprises a rod member curved through a 90° angle to form a short vertical leg for attaching to strut 27, and having a relatively long horizontal leg extending downstream parallel to the conveyor movement at an elevation just sufficient to clear the carton sides. Retainer 9 retains the rear flap in the opened position, once the flap has been pivoted open by drag link 7. Flexible rod 90 is attached to the downstream end of retainer 9, and may be fabricated from any resiliently flexible material, or alternatively, may be a relatively rigid rod flexibly coupled, as by a spring, to the horizontal leg. Rod 90 is included to keep the rear lateral flap closed while the operation of opening the front flap progresses. In particular, rod 90 will extend over the front flap while the flap is being pivoted upward by the front flap opening apparatus, the flexibility of rod 90 allowing it to deflect upward with the front flap so as not to inhibit the flap opening.

The apparatus for opening the front flap of the carton is located on the delivery conveyor downstream from the second frame member 29, and comprises (i) sprocket frame member 28; (ii) first and second sprockets and first and second idler sprockets rotating on horizontal shafts at the side of the conveyor; (iii) an endless chain reeved around the first and second sprockets; (iv) hook means coupled to a link in the endless chain and disposed over the moving cartons; and (v) means for driving the chain in synchronization with carton movement on the conveyor at a speed substantially exceeding the speed of the cartons, and predetermined in accordance with the chain length to return the hook means to the same position as each carton reaches the front flap opening apparatus (in one embodiment, approximately twice the lineal speed of the cartons).

Sprocket frame member 28 is attached between second frame member 29 and support frame 30, which frame 30 may, for example, comprise part of a bottle uncaser as described in U.S. Pat. No. 3,938,847. The plane of the frame member 28 is disposed in a substantially vertical direction, and extends longitudinally parallel to the direction of movement of the delivery conveyor, above the delivery conveyor and offset from the corridor 100 defined by the carton sides as cartons move on the conveyor. (The corridor 100 is shown in phantom in FIG. 3.) Sprockets 11, 13, 14 and 15 are mounted on horizontal shafts 110, 130, 140 and 150, bearing supported on the sprocket frame member 28 in a spaced apart relationship. The position of shaft 140 is selectable within slot 142, shown in FIG. 2 as an adjustment to allow handling of various sized boxes and flap lengths. Conventional securing means (not shown) are used to secure the shaft 140 in the selected position. For efficient operation of the apparatus without damaging the flaps of the cartons, the radius of sprocket 13 should preferably be no larger than four to five times the length of curved extension 192 of hook means 19 (as will be discussed hereinbelow). Endless chain 17 is reeved around sprockets 11 and 15, and passes over idler sprocket 13 and under idler sprocket 14, sprocket 13 urging the chain 17 upward, forming a peak in the lower trajectory of the chain 17 between sprockets 11 and 14. In the preferred embodiment of the present invention, at least one of the pins which secure the individual links together is a hollow pin non-rotatable with respect to one set of adjacent link portions. (An example of a chain having non-rotatable pins is the engineering chain shown and described in the "Mechanical Engineers' Handbook", by Lionel S. Marks [McGraw-Hill, 1951, fifth Edition], at page 1367.) Coupled through the non-rotatable pin is an elongated bar 190 extending over the delivery conveyor as shown in FIG. 1. Hook means 19 is integrally formed on the end of bar 190 by appropriate bends in he bar, also forming angled extension 192, best shown in FIGS. 1 and 2. Thus, hook means 19 is constrained to follow the trajectory of the chain, around the sprockets 11 and 15, over idler sprocket 13 and under idler sprocket 14. The movement of the hook means 19, when driven in a counterclockwise direction of rotation as viewed from FIG. 2, is firstly around the bottom of sprocket 11, then along an upwardly sloped direction over idler sprocket 13, then in a downwardly sloped direction from idler sprocket 13 to the underside of idler sprocket 14, and finally along a horizontal path between idler 14 and sprocket 15.

Again referring to FIG. 1, sprocket 153 is attached to shaft 151 on the opposite side of frame member 28 from sprocket 15. In the preferred embodiment, chain 154 couples sprocket 153 to sprocket 156 (see FIG. 2) synchronized to the operation of the uncaser. Since the cartons are synchronized to the uncaser, the coupling synchronizes the motion of the hook means 19 with cartons on the conveyor.

As previously described, sprocket frame member 28 is elevated above and offset from the cartons as they proceed along the conveyor; similarly sprockets 11, 13, 14 and 15 and chain 17 are offset from the cartons with bar 190 extending out over the interior of the cartons. The location of sprocket 11 and the dimensions of hook means 19 are selected so that when bar 190 passes under sprocket 11, the tip of hook means 19 swings below the elevation of the top of the sides of a carton on the conveyor, e.g. below the edge of the forward flap, executing a scooping motion as it passes under the sprocket to flip the forward flap to a partially opened position.

The movement of the hook means 19 is synchronized with the position of the cartons on the conveyor so that when hook means 19 passes beneath shaft 110, the edge of the folded front flap has just passed beneath the shaft 110. The tip of the angled extension 192 is disposed under the flap and engages the underside of the folded flap (as shown in FIG. 5(*a*). It is necessary, in order to avoid bending and damaging the box flaps, that the transition in the trajectory of angled extension 192 caused by sprocket 11 be relatively sharp, so that the hook means does not proceed horizontally downstream sufficiently during this transition to catch the flap in the crook of the hook means and drive the flap horizontally, thereby bending, tearing or otherwise damaging the flap. The turning radius of the hook means 19, when driven around sprocket 11 should be sufficiently small so that the tip of angled extension 192 engages the underside of the flap and initially flips it up, so that the flap rides against the tip of extension 192 (as suggested in FIG. 5(*b*)). This initially raises the edge of the flap above bar 190 to eliminate any possible interference between the bar and flap through the opening sequence of FIGS. 5*a*–5*d*. By choosing a sprocket 11 radius of less than approximately five times the length of angled extension 192, the turning radius is sufficiently small so that the apparatus operates reliably without detriment to the carton flaps.

Flap retainer 23 is disposed downstream from the idler sprocket 13 parallel to the conveyor, and comprises an elongated member extending along the conveyor just above the top of the carton, having an upstream end 230 bend upwardly at an incline. Retainer 23 urges the forward flap downward, once it has been substantially opened by the hook means 19, and maintains both front and rear flap in the opened position.

Having described the structure of the preferred embodiment of the present invention, the operation of the apparatus will now be described. The closed cartons are disposed onto the delivery conveyor and are delivered to the flap opening apparatus. The movement of the delivery conveyor is continuous; thus the cartons are moving at a substantially constant speed along the conveyor belt. The longitudinal flaps are initially urged upward by a stream of air or vacuum means. As the carton continues along the conveyor 1, blade 3 and helical rails 5 engage the undersides of the partially lifted longitudinal flaps and urge the flaps outward into a substantially opened position, which is maintained by retaining rails 22. Drag link 7 contacts the front side of the box as it moves along the conveyor, and pivots upward, dogleg 72 sliding along the front of the box and over the folded front lateral flap. Drag link 7 will then drop into the carton until the edge of the rear lateral flap is contacted by the dogleg 72 of the drag link 7. As carton movement continues, the rear lateral flap is engaged by the drag link 7 which pivots upwardly thereby causing the rear flap to also pivot upwardly and to strike the rear flap retainer 9. Further carton movement disposes the flap outwardly with respect to the carton sides, into the opened position, with retainer 9 maintaining the rear flap in its opened position. (The open position for the side flaps is below the tops of the sides of the carton, whereas the open position for the front and rear lateral flaps is the horizontal forward and rearward extending positions respectively.)

As movement of the carton along the conveyor continues, the edge of the folded front flap will be disposed under the sprocket 11. The opening of the front lateral flap is sequentially shown in FIGS. 5(*a*–*d*). Due to the synchronization of the chain with the conveyor movement, (such as by way of the synchronization apparatus associated with the uncaser of U.S. Pat. No. 3,938,847) angled extension 192 of hook means 19 will momentarily swing into the interior of the carton to engage the underside of the front flap, swinging the flap upward so that the edge of the flap passes above the support bar 190 (see FIG. 1). Chain 17 is driven at a speed exceeding that of the cartons, selected in accordance with the chain length to return the hook means 19 to the same position as each carton reaches the front flap opening apparatus. Because of the faster speed of the claim 17, the hook means 19 moves downstream with respect to the carton at a relative speed dependent upon the selected chain speed. The next part of the trajectory of the hook means 19 is inclined upwardly, as shown in FIG. 5(*b*). Thus the hook means 19 will clear the edge of the front panel of the carton, and will urge the lateral flap upwardly by bearing thereon at a point well displaced from the flap hinge. The next part of the trajectory of hook means 19 is downwardly inclined, to continue the outward pivoting motion of the forward lateral flap, as shown in FIG. 5(*c*). The horizontal portion of the hook trajectory between sprockets 14 and 15, and the retainer 23 ensures the complete opening of the flap, as shown in FIG. 5(*d*) while the horizontal portion of retainer 23 maintains the opened position of the lateral flaps during movement of the carton down the conveyor to a next processing station. The horizontal location of the second idler sprocket can be adjusted, so that the steepness of the downward movement and the extent of the subsequent horizontal movement can be varied to accomodate various front flap lengths, a very important aspect of this embodiment. Thus, the four flaps of a carton have been opened without requiring a mechanism for initially lifting the front lateral flap, so that the endless chain mechanism can engage the underside of the flap.

There has been described herein the preferred embodiment of the present invention. It is to be noted however, that alternative embodiments may be readily fabricated by one skilled in the art. By way of example, other means for opening the longitudinal carton flaps could be utilized in conjunction with the front flap opening apparatus of the present invention. Also, sprocket 14 can be eliminated and the other sprockets repositioned if desired, though such a three sprocket configuration tends to be limited in the flap size range it can accommodate. Thus, while the preferred embodiment of the present invention has been disclosed herein, various changes in form and details may be made therein without departing from the spirit and scope of the invention.

I claim:

1. Apparatus for opening the front flap of a carton moving on a conveyor system in synchronization with such apparatus, comprising:

a hook means for engaging a carton flap;

means for repeatedly disposing said hook means through a trajectory generally disposed in the direction of conveyor movement and over the conveyor, said trajectory including an upwardly inclined movement and a downwardly inclined movement, said upwardly inclined movement being initiated from a first point having a first height relative to the conveyor lower than the elevation of the top of the carton sides;

means for driving said hook means through said upwardly and downwardly inclined movements of said trajectory at a speed faster than the movement of said carton on said conveyor;

whereby said hook means engages such front flap at the beginning of said upwardly inclined portion of said trajectory and urges said flap edge forward with respect to the carton in an upwardly and then downwardly inclined movement to open the front flap of the carton.

2. The apparatus of claim 1 wherein said means for disposing said hook means through a trajectory includes:

first sprocket means and second sprocket means rotating on shafts disposed in a spaced apart parallel relationship;

an endless chain reeved about said first and second sprocket means;

at least one elongated bar extending from a link in said chain, said hook means being coupled to said bar; and an idler sprocket means rotating on a shaft and disposed between said first and second sprocket means, said idler sprocket means engaging the underside of said chain, thereby constraining said chain to pass over said idler sprocket means.

3. The apparatus of claim 2 wherein said second sprocket means has a diameter substantially twice that of said first sprocket means.

4. The apparatus of claim 2 wherein said means for driving said hook means is coupled to a means for driving the conveyor system.

5. The apparatus of claim 4 wherein said speed of said hook means is predetermined in accordance with the length of said chain to return said hook means to substantially the same position as each carton reaches such front flap opening apparatus.

6. The apparatus of claim 1 wherein said trajectory further includes a horizontal movement.

7. The apparatus of claim 1 further comprising a lateral flap retainer bar disposed horizontally above and along said conveyor downstream of said apparatus, said bar having an upwardly inclined portion adjacent said apparatus.

8. The apparatus of claim 1 wherein said hook means comprises an elongated member having a straight section and an angled extension joined to said straight section at an obtuse angle.

9. The apparatus of claim 8 wherein the radius of said first sprocket means is less than five times the length of said angled extension.

10. Apparatus for opening the flaps of a carton moving on a conveyor system in synchronization with such apparatus comprising:

means for initially lifting the folded longitudinal flaps of said carton;

a blade member for engaging the undersides of the initially lifted longitudinal flaps of said carton to further lift said flaps;

a pair of helically-curved rails, curving outwardly, first upwardly then downwardly along the side of the conveyor, each having a first end and a second end, said first end attached to said blade member for engaging a longitudinal flap, said rails guiding said flap open as said carton moves along said conveyor system;

a drag link member pivotally suspended above said conveyor for engaging the rear lateral flap of said carton in its folded condition and pivoting said flap open as said carton moves along said conveyor system;

means for opening the front lateral flap of a carton, including:

(i) a hook means for engaging a carton flap;

(ii) means for disposing said hook means through a trajectory generally disposed in the direction of conveyor movement and over said conveyor, said trajectory including an upwardly inclined and a downwardly inclined movement, said upwardly inclined movement being initiated from a first point having a first height relative to the conveyor, said height being lower than the elevation of the top of the carton sides; and (iii) means for driving said hook means through said upwardly and downwardly inclined movements of said trajectory at a speed faster than the movement of said carton on said conveyor;

whereby said longitudinal flaps are opened by said blade member and said helical rails, said rear flap of said carton is opened by engagement of said drag link, and said front flap is substantially opened by the engagement of said hook means at the beginning of said upwardly inclined portion of said trajectory to urge said flap edge forward with respect to said carton in an upwardly and then downwardly inclined pivoting action to substantially open the front flap of such carton.

11. The apparatus of claim 10 wherein said means for driving said hook means is coupled to a means for driving the conveyor system.

12. The apparatus of claim 10 wherein said speed of said hook means is predetermined in accordance with the length of said chain to return said hook means to substantially the same position as each carton reaches such front flap opening apparatus.

13. The apparatus of claim 10 wherein the second end of said helical rails is attached to an elongated rod extending on each side of said conveyor for retaining said longitudinal flaps in the open condition.

14. The apparatus of claim 10 wherein said drag link comprises an elongated rod member having a dogleg formed in the lower end thereof.

15. Apparatus for opening the flaps of a carton moving on a conveyor system in synchronization with such apparatus comprising:

means for initially lifting the folded longitudinal flaps of said carton;

a blade member for engaging the undersides of the initially lifted longitudinal flaps of said carton to further lift said flaps;

a pair of helically-curved rails, curving outwardly, first upwardly then downwardly along the side of the conveyor, each having a first end and a second end, said first end attached to said blade member for engaging a longitudinal flap, said rails guiding said flap open as said carton moves along said conveyor system;

a drag link member pivotally suspended above said conveyor for engaging the rear lateral flap of said carton in its folded condition and pivoting said flap open as said carton moves along said conveyor system;

means for opening the front lateral flap of a carton, including:

(i) a hook means for engaging a carton flap;

(ii) means for disposing said hook means through a trajectory generally disposed in the direction of conveyor movement and over said conveyor, said trajectory including an upwardly inclined and a downwardly inclined movement, said upwardly inclined movement being initiated from a first point having a first height relative to the conveyor, said height being lower than the elevation of the top of the carton sides, said means including:

first sprocket means and second sprocket means each rotating on shafts disposed in a spaced apart relationship;

an endless chain reeved about said first and second sprocket means;

at least one elongated bar extending from a link in said chain, said hook means being coupled to said bar; and a first idler sprocket means rotating on a shaft and disposed between said first and second sprocket means, said idler sprocket means engaging the underside of said chain, thereby constraining said chain to pass over said idler sprocket means, and (iii) means for driving said hook means through said upwardly and downwardly inclined movements of said trajectory at a speed faster than the movement of said carton on said conveyor;

whereby said longitudinal flaps are opened by said blade member and said helical rails, said rear flap of said carton is opened by engagement of said drag link, and said front flap is substantially opened by the engagement of said hook means at the beginning of said upwardly inclined portion of said trajectory to urge said flap edge forward with respect to said carton in an upwardly and then downwardly inclined pivoting action to substantially open the front flap of such carton.

16. The apparatus of claim 15 wherein said trajectory further includes a horizontal movement, and said means for disposing said hook means through a trajectory further includes a second idler sprocket means disposed between said first idler sprocket means and said second sprocket means.

17. The apparatus of claim 15 wherein said second sprocket means has a diameter substantially twice that of said first sprocket means.

18. The apparatus of claim 15 wherein said hook means comprises a cylindrical member having a straight section and an angled extension joined to said straight section at an obtuse angle.

19. The apparatus of claim 18 wherein the radius of said first sprocket means is less than five times the length of said angled extension.

20. Apparatus for opening the front flap of a carton moving on a conveyor system in synchronization with such apparatus, comprising:

a hook means for engaging a carton flap;

means for repeatedly disposing at least one hook means through a trajectory generally disposed in the direction of conveyor movement and over the conveyor, said trajectory including a downward scooping movement transitioning to an upwardly inclined movement, which upwardly inclined movement in turn transitions to a downwardly inclined movement which downwardly inclined movement in turn transitions to a substantially horizontal movement, said scooping movement swinging said hook means through a first point having a first height relative to the conveyor slightly lower than the elevation of the top of the carton sides, said means including:

first sprocket means and second sprocket means rotating on shafts disposed in a spaced apart parallel relationship;

an endless chain reeved about said first and second sprocket means;

at least one elongated bar extending from a link in said chain, said hook means being coupled to said bar;

first idler sprocket means rotating on a shaft and disposed adjacent said first sprocket means, said idler sprocket means engaging the underside of said chain, thereby constraining said chain to pass over said idler sprocket means; and second idler sprocket means rotating on a shaft and disposed between said first idler sprocket means and said second sprocket means, said chain passing over said second idler sprocket means and;

means for driving said hook means through said trajectory at a speed faster than the movement of said carton on said conveyor;

whereby said hook means engages such front flap during said scooping movement of said hook means and urges said flap edge forward with respect to the carton in an upward, then downwardly inclined finally horizontal movement to open the front flap of the carton.

21. The apparatus of claim 20 wherein said second sprocket means has a diameter substantially twice that of said first sprocket means.

22. The apparatus of claim 20 wherein said means for driving said hook means is coupled to a means for driving the conveyor system.

23. The apparatus of claim 22 wherein said speed of said hook means is predetermined in accordance with the length of said chain to return said hook means to substantially the same position as each carton reaches such front flap opening apparatus.

24. The apparatus of claim 20 wherein said hook means comprises an elongated member having a straight section and an angled extension joined to said straight section at an obtuse angle.

25. The apparatus of claim 24 wherein the radius of said first sprocket means is less than five times the length of said angled extension.

26. The apparatus of claim 20 wherein the position of said second idler sprocket is adjustable in the horizontal direction.

27. Apparatus for opening the front flap of a carton moving on a conveyor system in synchronization with such apparatus, comprising:

a hook means for engaging a carton flap;

means for repeatedly disposing at least one hook means through a trajectory generally disposed in the direction of conveyor movement and over the conveyor, said trajectory including a downward scooping movement transitioning to an upwardly inclined movement, which upwardly inclined movement in turn transitions to a downwardly inclined movement which downwardly inclined movement in turn transitions to a substantially horizontal movement, said scooping movement swinging said hook means through a first point having a first height relative to the conveyor lower than the elevation of the top of the carton sides; and means for driving said hook means through said trajectory at a speed faster than the movement of said carton on said conveyor;

whereby said hook means engages such front flap during said scooping movement of said hook means and urges said flap edge forward with respect to the carton in an upward, then downwardly inclined movement and finally horizontal movement to open the front flap of the carton.

28. The apparatus of claim 27 further comprising a lateral flap retainer bar disposed horizontally above and along said conveyor downstream of said apparatus, said bar having an upwardly inclined portion adjacent said apparatus.

29. Apparatus for opening the front flap of a carton moving on a conveyor system in synchronization with such apparatus, comprising:

a hook means for engaging a carton flap;

means for repeatedly disposing said hook means through a trajectory generally disposed in the direction of conveyor movement and over the conveyor, said trajectory including an upwardly inclined movement, a downwardly inclined movement, and a horizontal movement, said upwardly inclined movement being initiated from a first point having a first height relative to the conveyor lower than the elevation of the top of the carton sides, said means including:

first sprocket means and second sprocket means for rotating on shafts disposed in a spaced apart parallel relationship;

an endless chain reeved about said first and second sprocket means;

at least one elongated bar extending from a link in said chain, said hook means being coupled to said bar; and first and second spaced idler sprocket means rotating on shafts and disposed between said first and second sprocket means, said chain passing over said first idler sprocket means, and under said second idler sprocket means;

means for driving said hook means through said upwardly, downwardly and horizontally inclined movements of said trajectory at a speed faster than the movement of said carton on said conveyor;

whereby said hook means engages such front flap at the beginning of said upwardly inclined portion of said trajectory and urges said flap edge forward with respect to the carton in an upwardly and then downwardly inclined movement to open the front flap of the carton.

* * * * *